United States Patent [19]

Barton

[11] 4,201,002

[45] May 6, 1980

[54] CONTINUOUS VISUAL DISPLAY APPARATUS

[76] Inventor: Edson K. Barton, 552 W. 750 S., Orem, Utah 84057

[21] Appl. No.: 798,892

[22] Filed: May 20, 1977

[51] Int. Cl.[2] ..... G09F 11/12

[52] U.S. Cl. ..... 40/524; 40/472

[58] Field of Search ..... 40/472, 438, 524

[56] References Cited

U.S. PATENT DOCUMENTS

| | | | |
|---|---|---|---|
| 947,828 | 2/1910 | Lennox | 40/472 |
| 1,355,716 | 10/1920 | Trevail | 40/472 |
| 1,598,658 | 9/1926 | Rogers | 40/472 |
| 1,762,685 | 1/1930 | Hartman et al. | 40/472 |
| 1,807,649 | 6/1931 | Brown | 40/472 |
| 2,183,705 | 12/1939 | Wooten | 40/472 |
| 2,876,567 | 3/1959 | Gooden | 40/472 |
| 3,552,049 | 1/1971 | Foote | 40/472 |

*Primary Examiner*—Louis G. Mancene

*Assistant Examiner*—John J. Wilson

*Attorney, Agent, or Firm*—Criddle & Western

[57] ABSTRACT

An extremely dependable, rugged display apparatus is provided for continuously displaying a portion of an endless tape, web, or belt containing visual messages or markings thereon. The endless tape, web, or belt moves from a storage space at the back of the apparatus, where excess slack in the tape, web, or belt is stored in loose folds, to and beneath a floating idler roller at the bottom of the apparatus. The tape, web, or belt then moves between a flat plate and a transparent sheet at the front of the apparatus to a drive roller at the top of the apparatus. The transparent sheet forms at least a portion of the front panel of the apparatus, and the flat plate is positioned flatwise directly behind and spaced from the transparent sheet. The tape, web, or belt passes between the drive roller and a free rolling, nip roller which is supported by the drive roller, and, then, back to the storage space.

10 Claims, 6 Drawing Figures

CONTINUOUS VISUAL DISPLAY APPARATUS

BACKGROUND OF THE INVENTION

1. Field

The invention pertains to apparatus for continuously displaying a portion of an endless tape, belt, or web by passing the tape, belt, or web from a storage space past a display area and back to the storage space.

2. State of the Art

Various display devices have been developed in the past for continuously exhibiting visual matter on an endless belt or web. Such devices are shown in U.S. Pat. Nos. 947,828; 1,008,260; 1,355,716; 1,762,685; 1,807,649; 1,858,208; 1,973,983; 2,033,478; 2,160,886; 2,328,648; and 2,649,797. As can be seen, there have been many attempts made to produce a display apparatus of this type. The prior devices have not been commercially successful for a number of reasons; chiefly because they were unreliable of complicated construction, expensive to manufacture and maintain, and complicated, intricate procedures were required to change the tapes, webs, or belts in the devices for showing new matter on the new tapes, webs, or belts.

3. Objective

The principal objective of this invention was to develop a reliable, compact, display apparatus for continuously exhibiting matter on an endless tape, web, or belt, and to provide such an apparatus in which the endless tape, web, or belt can be easily and readily removed and reinstalled, and the length of the tape, web, or belt can be easily and readily varied. The apparatus is simple and rugged in its construction, and is essentially carefree, being capable of operating over essentially limitless time periods without costly maintenance, or without becoming jammed and inoperable.

SUMMARY OF THE INVENTION

In accordance with the invention, the foregoing objective is achieved by providing apparatus comprising a cabinet having a bottom forming the floor of the inside of the cabinet, a back panel, side panels, and a front panel of which at least a portion thereof comprises a transparent sheet defining a display area. At least one of the side panels of the cabinet opens to give access to the inside thereof.

An essentially flat plate is positioned within the cabinet flatwise directly behind and spaced from the transparent sheet, with the bottom edge of the plate being spaced from the floor of the cabinet. Positioned lengthwise along the top of the flat plate is an essentially horizontally disposed drive roller, with the longitudinal axis of the drive roller being essentially parallel with the plane of the flat plate.

Mutually spaced, elongate retaining members are positioned above the drive roller so that the longitudinal open space between the two retaining members is directly above the drive roller. A nip roller is positioned within the open space between the elongate retaining members, so that the nip roller is supported by the drive roller.

A storage space is provided behind the flat plate. An endless display tape, web, or belt is adapted to continuously move in a circuitous path from the storage space, wherein excess slack in the tape, web, or belt is stored in loose folds, to and beneath a floating idler roller positioned beneath the flat plate. From the idler roller, the tape, web, or belt travels between the flat plate and the transparent sheet and is pulled through the nip formed by the drive roller and the nip roller. The tape, web, or belt coming from the nip is then returned to the upper portion of the storage space behind the flat plate. The drive roller is driven with appropriate drive means, such as an electrical motor which is connected to the drive roller directly or through a gear or pulley system.

In a preferred embodiment of the apparatus, the flat plate, the drive roller, and means for driving the drive roller are mounted on a support structure which can be removed from the cabinet through the side thereof which opens. The support structure comprises a back wall adapted to slide endwise into the cabinet so as to be positioned flatwise against the back of the cabinet. A side wall is integrally connected to the side edge of the back wall so that when the back wall is moved into position against the back of the cabinet, the side wall of the support structure faces and is spaced from a corresponding side panel of the cabinet. The flat plate is attached to and supported by the side edge of the removable support structure, and the drive roller is supported at one end by the side wall and at the other end by a bearing supported by the flat plate.

In the preferred embodiment, the continuous belt or web is easily removed from the apparatus through the side thereof which opens by withdrawing the belt or web from around the open ends of the flat plate and drive roller. In reinstalling a belt or web in the apparatus, the nip roller is removed from its position above the drive roller, the floating idler roller is removed from the apparatus, and excess slack in the belt is slid into the storage space behind the flat plate while also sliding the looped belt or web along and around the flat plate and the drive roller. When the belt is positioned around the flat plate and drive roller, the nip roller is repositioned in its guides above the drive roller, and the floating idler roller is replaced in the apparatus so that it is positioned below the flat plate and within the loop formed by the belt or web. The belt or web can be removed and replaced from the open end of the apparatus without removing the support structure therefrom. However, one of the features of the invention is that the support structure, with the flat plate and drive roller, can be readily removed from the cabinet of the apparatus to facilitate the removal and reinstallation of replacement parts.

THE DRAWINGS

A particular construction representing the best mode presently contemplated of carrying out the invention is illustrated in the accompanying drawings, in which:

FIG. 1, is a perspective view of a display apparatus in accordance with this invention;

FIG. 2, a partially exploded perspective view showing the removable nature of the internal components of the apparatus;

FIG. 3, a side elevational view of the apparatus looking at the side thereof which opens, with the side in the open position;

FIG. 4, a vertical section taken along line 4—4 of FIG. 2;

FIG. 5, a vertical section taken along line 5—5 of FIG. 2; and

FIG. 6, a vertical section taken along line 6—6 of FIG. 1, with portions of the internal structure broken away to show the illumination and drive roller means of the preferred embodiment.

DETAILED DESCRIPTION OF THE ILLUSTRATED EMBODIMENT

Figure 1:
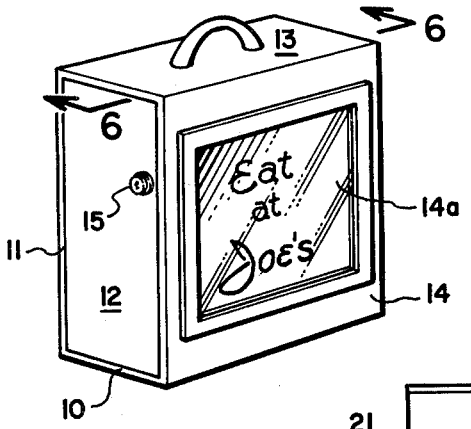

A compact, portable display apparatus in accordance with this invention is shown in perspective in FIG. 1, with the internal details thereof being illustrated in FIGS. 2–6.

Figure 2:
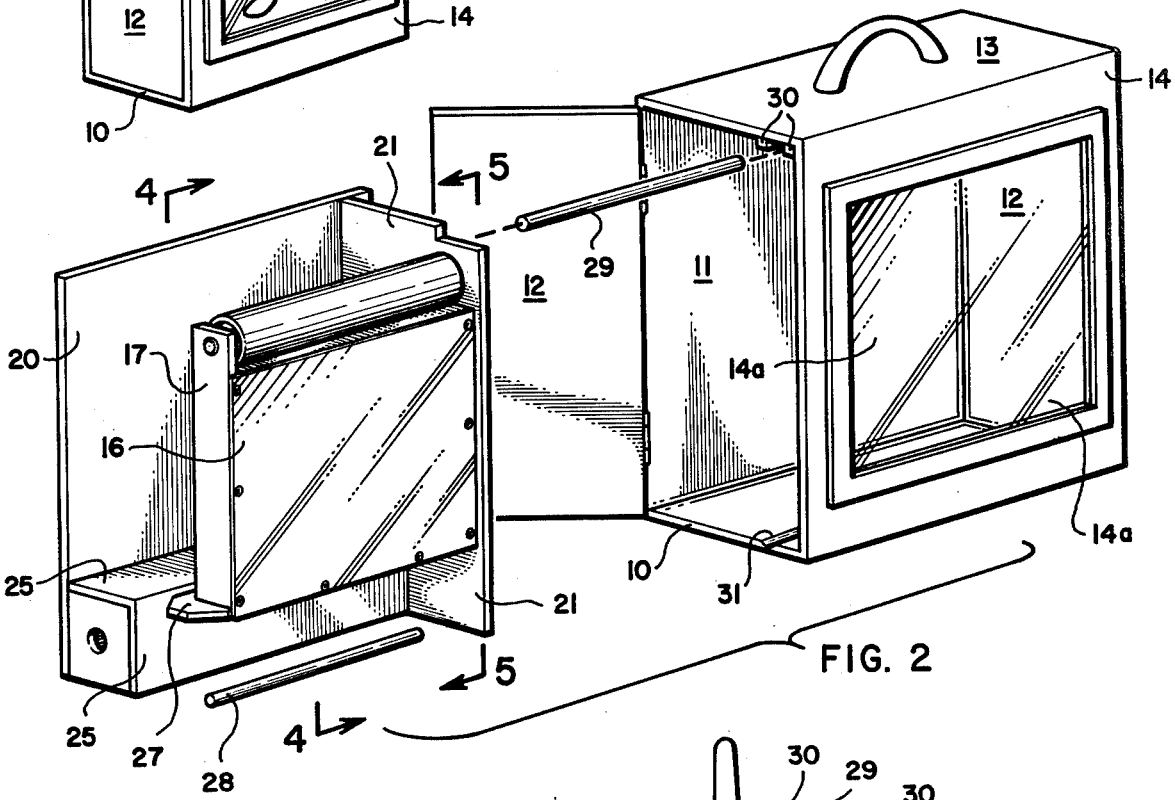
Figure 3:
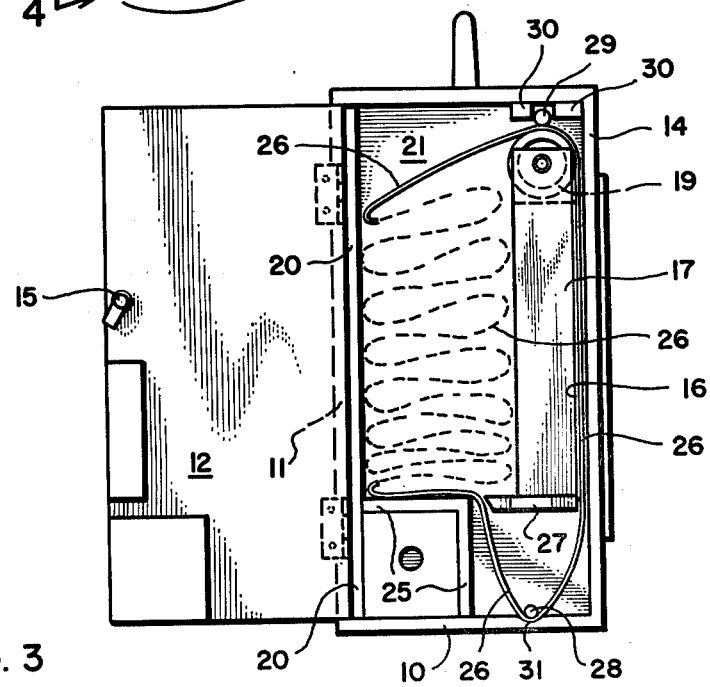

The apparatus comprises a cabinet having a bottom 10 forming the floor of the inside of the cabinet. A back panel 11, two side panels 12, a top panel 13, and a front panel 14 complete the outward extent of the cabinet. At least one of the side panels 12 is adapted to open as shown in FIGS. 2 and 3. A key latch 15 is provided to retain the opening side panel in its closed position.

At least a portion of the front panel 14 comprises a transparent sheet 14*a* defining a display area. An essentially flat plate 16 is positioned within the cabinet flatwise directly behind and spaced from the transparent sheet 14*a* of the front panel. The spacing between the flat plate 16 and the transparent sheet 14*a* is not critical. However, the space need not be much greater than an eighth to a fourth of an inch, i.e., just sufficient to allow the flexible, continuous belt or web to travel between the transparent sheet 14*a* and the flat plate 16 as described hereinafter.

In the preferred embodiment, as illustrated, the flat plate 16 is made of a translucent material and is incorporated into a shadowbox 17 positioned immediately therebehind. The shadowbox 17 contains illumination means, such as the fluorescent lamps 18 (FIGS. 5 and 6), which cast light through the translucent flat plate 16.

An essentially horizontally disposed drive roller 19 is positioned lengthwise along the top of the flat plate 16. In the illustrated embodiment, the drive roller 19 and the shadowbox 17 containing the flat plate 16 are mounted to and supported by a support structure which can be removed from the cabinet through the side thereof which opens. The support structure comprises a back wall 20 which is adapted to slide endwise into the cabinet so as to be positioned flatwise against the back panel 11 of the cabinet (see FIGS. 2 and 3). A side wall 21 is attached to the side edge of the back wall 20, so that when the back wall 20 is moved into its position against the back panel 11 of the cabinet, the side wall 21 of the support structure faces and is spaced from a corresponding side panel 12 of the cabinet. The flat plate 16 and shadowbox 17 are firmly fastened to the side wall 21 of the support structure and extend outwardly therefrom. The drive roller 19 is rotatably mounted at one of its ends to the flat plate 16 and at its other end to an upwardly standing extension of the side of the shadowbox 17. In those embodiments in which no shadowbox is utilized, the drive roller 19 is mounted at one end to the side wall 21 of the support structure and at the other end to a journal bearing which is in turn attached to the flat plate 16 by an appropriate attachment member.

Figure 4:
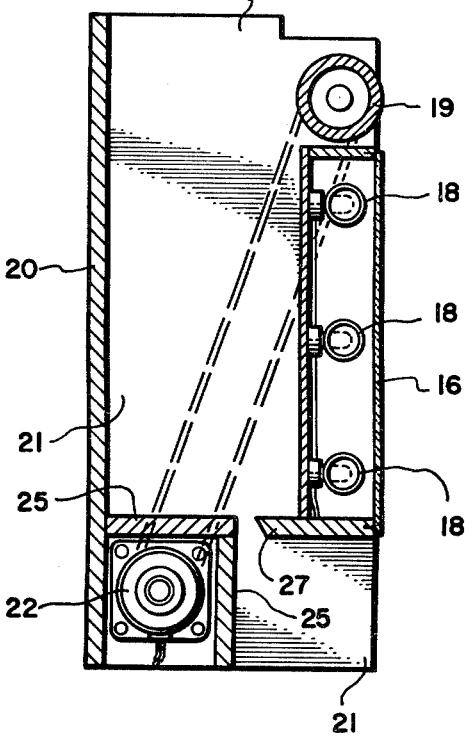
Figure 5:
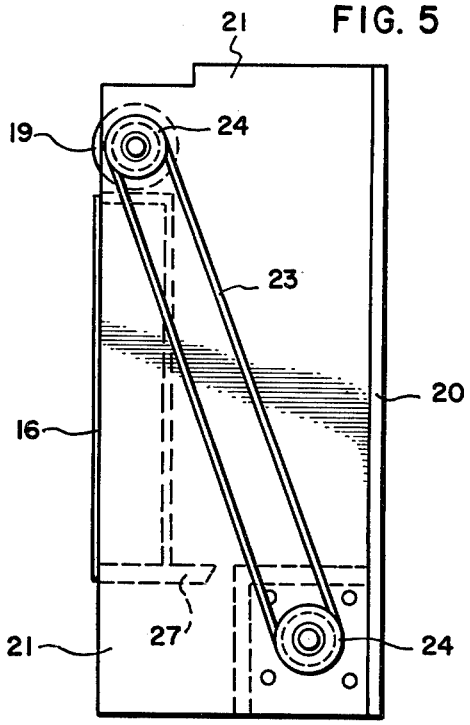
Figure 6:
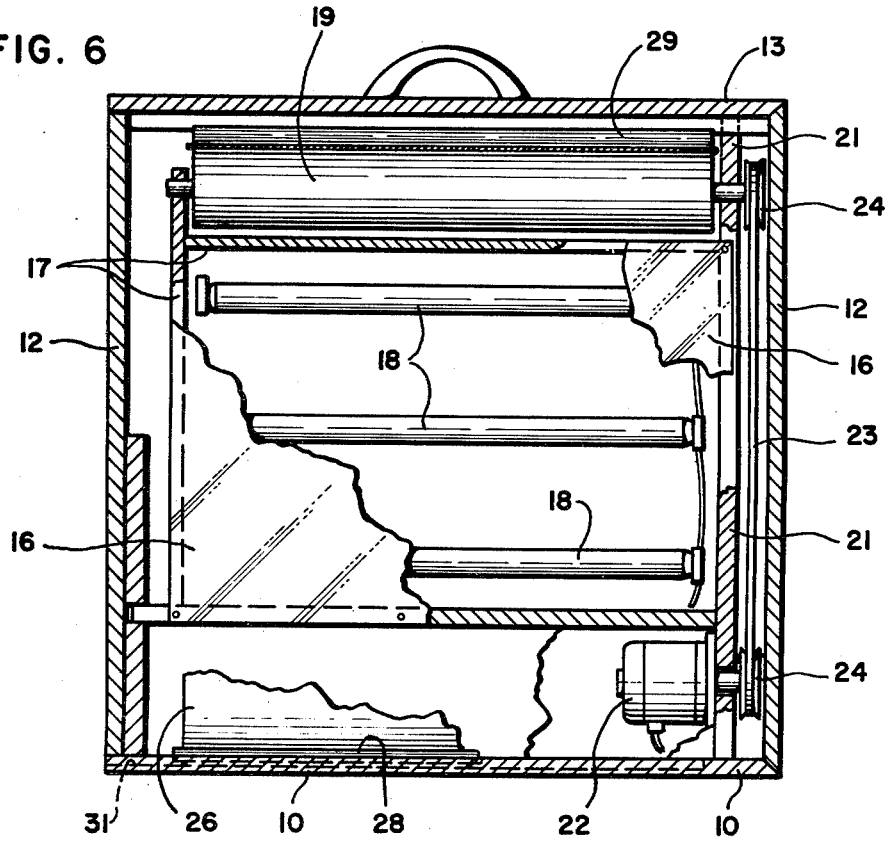

The drive roller 19 is driven by appropriate drive means, such as the electric motor 22 and the belt 23 and pulleys 24 shown in FIGS. 4–6. The motor 22 is conveniently mounted to the lower back corner of the side wall 21 of the support structure. Power from the motor 21 is transferred to the drive roller by the drive belt 23 which extends between pulleys 24 on the motor and the drive roller, respectively. The motor is conveniently housed in a housing 25 formed at the lower back corner of the back wall 20 of the support structure. The top of the housing 25, as explained hereinafter, forms the bottom of the storage space located in back of the shadowbox 17 and flat plate 16. The motor, especially in the larger sized apparatus of this invention, can conveniently be positioned at the end of the drive roller and connect directly thereto. A gear box may be incorporated into the motor to provide the proper speed of the drive roller.

An endless display tape, belt, or web 26 is adapted to be continuously movable in a circuitous path from the storage space, wherein excess slack is stored in loose folds (see FIG. 3), around the shadowbox 17 and flat plate 16 and back to the storage space. As illustrated, a shelf 27 extends rearwardly from the bottom of the shadowbox 17 and flat plate 16 at the same elevation as the top of the housing 25, and together with the top of the housing 25 forms the bottom of the storage space for the excess slack in the belt or web 26. The extending edge of the shelf 27 is spaced from the housing 25 to provide a longitudinal slot therebetween in which the belt or web passes in its travel around the shadowbox 17 and flat plate 16. It is not essential to provide the housing 25. Instead, the bottom of the storage space could be formed by a two-piece shelf extending from the bottom edge of the flat plate 16 to the back of the cabinet, the two pieces of such shelf being spaced from each other so as to form a longitudinal slot extending along the length of the shelf with the longitudinal axis of the slot being substantially parallel to the plane of the flat plate 16. In essence the two-piece shelf is the same as the top portion of the housing 25 and the shelf 27 as shown in the drawings. By connecting the motor 22 directly to the drive roller, the floor of the cabinet could be used as the bottom of the storage space for the excess slack in the tape, belt, or web 26, in which case there would be no need of housing 25 and shelf 27 as shown in the drawings.

The tape, web, or belt 26 passes from the storage space to and beneath a floating idler roller 28 and thence between the flat plate 16 and the transparent sheet 14*a* of the front panel 14. The free floating and rolling action of roller 28 prevents folded sections of the tape, web, or belt 26 from getting drawn into and entangled in the small space between the flat plate 16 and transparent sheet 14*a*. In addition, the roller 28 aids in guiding the tape, web, or belt into its proper position in the space between the flat plate 16 and transparent sheet 14*a*, thus increasing the tracking reliability of the tape, web, or belt 26. Means can be provided for biasing idler roller 28 so that its longitudinal axis cants towards the back of the apparatus from the side thereof which opens. Canting the idler roller in this manner tends to guide the tape, web, or belt inwardly towards the closed end of the apparatus, thereby preventing mistracking of the tape, web, or belt 26. As shown in FIGS. 2 and 3, the canting means comprises a longitudinal depression 31 in the floor 10 of the apparatus. The axis of the depression 31 slants towards the back of the apparatus from the open side, and the floating roller 28 rolls freely within this depression 31 so that the longitudinal axis of roller 28 is canted towards the back of the apparatus from the open side thereof. The essentially carefree operation of the present device over limitless periods of time is in a large part provided by the guiding and anti-jamming action of the floating roller 28.

From the space between the flat plate 16 and transparent sheet 14*a*, the belt or web 26 passes over the drive roller 19. A free rolling nip roller 29 is positioned above the drive roller 19 so that it rests lengthwise thereon, and the tape, belt, or web 26 passes between the nip formed by the drive roller 19 and the nip roller 29. The nip roller is retained in its free rolling position resting on the drive roller 19 by two elongate retaining members 30 positioned along each side of the nip roller 19. As illustrated, the retaining members 30 can be attached to the underside of the top 13 of the cabinet. Alternatively, the retaining members 30 could be attached to and extend from the sidewall 21 of the removable support structure. The nip roller 29 need not be the same length as the drive roller 19 and although such is preferred, the nip roller 29 can be a short roller or a series of short rollers distributed along the length of the drive roller 19.

The free rolling, nip roller 29 running on the drive roller 19 has been found to provide completely adequate traction for moving the tape, belt, or web 26 in its circuitous path through the apparatus. The apparatus can be of varied sizes, ranging from small portable display units, in which the display area is from several inches to 24 or 30 inches in heighth and width, to larger units having a display area of from 2 or 3 feet to 8 or 12 feet in heighth and width. The nip roller 29 provides sufficient traction even for the large models in which the tape, web, or belt is 8 to 12 feet wide. The free rolling, nip roller drive system of this invention contributes greatly to the reliability and simplicity of the apparatus. As mentioned earlier, the apparatus of this invention has been found to be operable for essentially limitless periods of time without having the tape, web, or belt 26 jam. The utter simplicity of the apparatus results in far less general maintenance being required than for the complex construction of prior art devices.

In addition, the apparatus of the present invention allows for simple and easy removal and reinstallation of the tape, web, or belt 26. To remove the tape, web, or belt 26, the idler roller 28 and nip roller 29 are removed by simply sliding them out through the open end of the cabinet. At this point, the removable support structure can be removed through the open end of the cabinet if desired; however, the tape, web, or belt 26 can be changed easily without removing the support structure from the cabinet. The tape, web, or belt 26 is simply pulled over the open end of the drive roller 29 and the shadowbox 17. The new tape, web, or belt 26 is replaced with the same ease as in removing the old one. Excess slack in the new tape, web, or belt is bunched together leaving a loop in the remaining portion thereof. The bunched portion is slid into the storage space while simultaneously sliding the loop portion around the drive roller 19 and shadowbox 17. The idler roller 28 and nip roller 29 are then replaced in their respective positions, and, if the support structure had been removed from the cabinet, it is simply slid back into its position within the cabinet. The removable nature of the support structure is of prime importance in doing general maintenance on the motor, the drive system and the bearings of the drive roller. By removing the support structure from the cabinet, access to all these items is provided for quick and easy maintenance thereof.

Instead of having a removable support structure, especially in larger sized embodiments of the present invention, individual components can be built into the apparatus so that they can be readily removed for customary maintenance work. The drive roller can be mounted on a removable support that rests on the top of the shadowbox and slides in and out of the apparatus. Lighting elements in the shadowbox can also be installed on sliding supports which can be removed from the shadowbox through the open end of the apparatus.

Whereas this invention is here illustrated and described with specific reference to an embodiment thereof which is presently contemplated as the best mode of carrying out the invention in actual practice, it is to be understood that various changes may be made in adapting the invention to different embodiments without departing from the broader inventive concepts disclosed herein and comprehended by the claims that follow.

What I claim is:

1. A display apparatus for continuously exhibiting matter on an endless belt or the like, comprising a cabinet having a bottom, a floor inside of the cabinet, a back panel, a front panel, at least a portion of said front panel comprising a display area, and side panels, at least one of which opens to give access to the inside of the cabinet; an essentially flat plate in said cabinet, said plate being positioned flatwise directly behind and spaced from the display area with the bottom edge of said plate being spaced from the floor of the cabinet, and said plate being supported by support structure at a side of said cabinet opposite to a side thereof which opens; an essentially horizontally disposed drive roller positioned along the top of said plate, with the longitudinal axis of said drive roller being essentially parallel with the plane of said plate, said drive roller being supported at one of its ends from said support structure and at the other of its ends by bracket means extending from said plate; mutually spaced retaining members positioned above the drive roller; a nip roller positioned in the space between the retaining members and supported by the drive roller; means for driving the drive roller; a storage space behind the flat plate; an endless display belt or web, having excess slack therein which is stored in said storage space, said belt or web being continuously movable in a circuitous path from the storage space, between the flat plate and the display area to the drive roller, then between the drive roller and the nip roller, and back to the storage space wherein said excess slack is stored in loose folds; and retaining means positioned below the flat plate for guiding the belt or web into the passage between the flat plate and the display area and preventing entanglement of the belt or web as it feeds between the flat plate and the display area.

2. A display apparatus in accordance with claim 1, wherein the restraining means is adapted to bias the belt or web toward the side of the cabinet from which the plate and drive roller are supported.

3. A display apparatus in accordance with claim 1, wherein the flat plate is translucent and a shadowbox containing a light source is positioned immediately behind the flat plate so as to cast light through the translucent flat plate.

4. A display apparatus in accordance with claim 1, wherein said support on which the flat plate and the drive roller are mounted can be removed from the cabinet through said side thereof which opens.

5. A display apparatus in accordance with claim 4, wherein the removable support structure comprises a back wall adapted to slide endwise into the cabinet so as to be positioned flatwise against the back of the cabinet; and a side wall connected to the side edge of said back wall so that when the back wall is moved into position against the back of the cabinet said side wall faces and is spaced from a corresponding side panel of the cabinet.

6. A display apparatus in accordance with claim 5, wherein the flat plate is attached to and supported by the side edge of the removable support structure, and the drive roller is supported at one end by the side wall of the removable support structure and at the other end by said flat plate, whereby the endless belt or web can be readily positioned in and removed from its circuitous path around the flat plate and the drive roller.

7. A display apparatus in accordance with claim 5, wherein the flat plate is translucent; a shadowbox containing a light source is positioned immediately behind the flat plate so as to cast light through the translucent flat plate, said shadowbox being attached to and supported from the side wall of the removable support structure, with said flat plate and drive roller being supported at one end by the side wall of the removable support structure and at the other end by said shadowbox.

8. A display apparatus in accordance with claim 7, wherein the translucent flat plate is removably attached to the shadowbox.

9. A display apparatus for continuously exhibiting matter on an endless belt or the like, comprising a cabinet having a bottom forming a floor inside of the cabinet, a back panel, a front panel, at least a portion of said front panel comprising a display area, and side panels, at least one of which opens to give access to the inside of the cabinet; an essentially flat plate in said cabinet, said plate being positioned flatwise directly behind and spaced from the display area in said front panel, with the bottom edge of said plate being spaced from the floor of the cabinet, an essentially horizontally disposed drive roller positioned along the top of said plate, with the longitudinal axis of said drive roller being essentially parallel with the plane of said plate; mutually spaced, retaining members positioned above the drive roller; a nip roller positioned in the space between the retaining members and supported by the drive roller; means for driving the drive roller; a storage space behind the flat plate; a floating idler roller located below the flat plate; an endless display belt or web continuously movable in a circuitous path from the storage space to and beneath said floating idler roller, then between the flat plate and the display area in said front panel to the drive roller, then between the drive roller and the nip roller, and back to the storage space wherein the excess slack in the belt or web is stored in loose folds; and means for biasing the floating idler roller so that it cants toward the back of the apparatus.

10. A display apparatus in accordance with claim 9 wherein the means for biasing the floating idler roller comprises a longitudinal depression in the floor of the apparatus, the longitudinal axis of which cants towards the back of the apparatus, whereby the floating idler roller rolls within this depression.

* * * * *